United States Patent [19]

Lujan, Jr.

[11] Patent Number: 4,606,325

[45] Date of Patent: Aug. 19, 1986

[54] MULTI-CONTROLLED WATER CONSERVATION SYSTEM FOR HOT WATER LINES WITH LOW PRESSURE UTILIZATION DISABLE

[76] Inventor: Albert G. Lujan, Jr., 625 W. Calle Castille, Tucson, Ariz. 85706

[21] Appl. No.: 814,002

[22] Filed: Dec. 17, 1985

Related U.S. Application Data

[63] Continuation-in-part of Ser. No. 669,451, Nov. 8, 1984, abandoned.

[51] Int. Cl.[4] ..... F24H 1/00

[52] U.S. Cl. ..... 126/362; 237/8 A; 417/32; 219/296

[58] Field of Search ..... 126/36; 417/32; 237/8 A, 8 C, 8 R; 219/296; 236/24.5, 20 R

[56] References Cited

U.S. PATENT DOCUMENTS

| | | | |
|---|---|---|---|
| 2,291,023 | 7/1942 | Burklin | 126/362 |
| 2,399,985 | 5/1946 | Chandler | 237/8 |
| 2,842,155 | 7/1958 | Peters | 126/362 X |
| 2,915,080 | 12/1959 | Holmes | 126/362 X |
| 3,705,574 | 12/1972 | Duncan | 126/362 |
| 4,141,222 | 2/1979 | Ritchie | 62/179 |
| 4,142,515 | 3/1979 | Skaats | 126/362 |
| 4,201,518 | 5/1980 | Stevenson | 417/32 X |
| 4,321,943 | 3/1982 | Haws | 137/337 |
| 4,450,829 | 5/1984 | Morita et al. | 126/362 |

*Primary Examiner*—Randall L. Green
*Attorney, Agent, or Firm*—Victor Flores

[57] ABSTRACT

A water conservation system for use in residential dwellings or other buildings having a hot water distribution system. The system conserves water which is typically wasted by users while waiting for warm water to flow from a hot water faucet. The system provides a recirculating cooled hot water supply line from the cooled-off end of a hot water line back to the hot water heater of the hot water distribution system. The system is provided with a plurality of control means to electrically energize the system's recirculating pump so long as a pressure switch detects that the main water supply is providing sufficient water pressure to the system. In operation the recirculating pump opens a check valve in the recirculating line and closes the check valve in the main water supply line and recirculates the cooled hot water back to the hot water heater for ultimate use. If the main water supply has insufficient pressure, the recirculating cooled hot water system is non-functional.

2 Claims, 2 Drawing Figures

MULTI-CONTROLLED WATER CONSERVATION SYSTEM FOR HOT WATER LINES WITH LOW PRESSURE UTILIZATION DISABLE

This application is a continuation-in-part of application Ser. No. 669,451, filed 11/8/84, now abandoned.

BACKGROUND OF THE INVENTION

1. Field of the Invention

The present invention generally relates to water conservation systems for use in a dwelling or other building having a hot water distribution system which utilizes a pressurized main water supply, such as a city water main, as its primary source of cold water and more particularly, is concerned with an affordable water conservation system which provides a recirculating cooled hot water supply line back to the hot water heater in the hot water distribution system from the cooled-off standing hot water in the hot water lines. The conservation system further relates to the use of various electrical control devices that are rendered non-functional when used in conjunction with a pressure sensitive device that shuts off the system if the main water supply loses its pressure.

2. Description of the Prior Art

Water is a precious natural resource and in today's modern world, man has invented conveniences which circumstantially have and are depleting this precious natural resource. The hot water system is one of man's inventions which is contributing to depletion of this resource. In particular, hot water systems have conditioned man to not come into contact with the water flowing from outlet faucets until the water has reached a comfortable temperature. Typically, in today's hot water systems, the water that flows from the outlet faucet while waiting for comfortable warm water to flow is wasted down the drain.

Although there are water conservation systems which have addressed this problem, they have the drawback in that it involves the utilization of expensive, specialized valves and control systems which do not fully accomplish the water conservation task and therefore override the water conservation objective. One such system is described and illustrated in U.S. Pat. No. 4,142,515 to L. E. Skaats. The Skaats patent discloses a timed water recirculating system wherein a recirculating pump is responsive to a drop in water pressure and requires a pressure switch and a timer circuit apparatus which are specialized componentry. Similarly, in U.S. Pat. No. 4,450,829 to D. I. Morita, et al, a water conservation system is described and illustrated which requires the use of a special temperature and pressure dependent control unit to accomplish the water conservation objective. In both the Skaats and the Morita patents, the user does not fully conserve all possible water in that water is still waster during initial use and also the user does not have any control as to when to use the system. These systems, while recirculating the cooled hot water, waste water during initial use and further do not include a system utilization lock-out or disable means for the case of low or complete loss of water pressure from the main water supply. This deficiency defeats the water conservation objective and further present a potential problem of draining the stored water in a hot water heater if used while there is a loss of water pressure from the main water supply.

Consequently, a need exists for a simple and affordable water conservation system which can accomplish the water conservation objective brought about by the waste of water during the warm-up period of water flow from the hot water faucet in a hot water system. More specifically, a need exists for a cooled hot water recirculating water conservation system which will conserve water using manual control means as well as automatic means but which will be rendered non-functional if the main water pressure is low or completely lost.

SUMMARY OF THE INVENTION

The principal object of the invention is directed at providing the user of a hot water system with an affordable and easy to use water conservation system which will recirculate the cooled hot water in the system back to the hot water heater and thus conserve on that water which is typically wasted while the user is waiting for warm water to flow from a hot water outlet faucet.

Another object is to provide a water conservation system having a plurality of electrical control means for utilizing the system which depends upon having a predetermined amount of water pressure from the main water supply. The control means includes a manual control means which allows the discretionary utilization of the system, a timer clock based control means and a thermostat control means.

Accordingly, the present invention rlates to a water conservation system for use in dwellings or other buildings having a hot water system distribution system, whereby a recirculating cooled hot water supply line is provided back to the water heater from remote hot water faucet locations and allows the cooled hot water to be used instead of being wasted down a drain while a comfortable water temperature is reached. The system is provided with a plurality of electrical control means for energizing the recirculating pump used in the system. The control means are gated by a water pressure switch to prevent using the system whenever the water pressure from the main water supply drops below a predetermined pressure.

DETAILED DESCRIPTION OF THE PREFERRED EMBODIMENT

Figure 1:
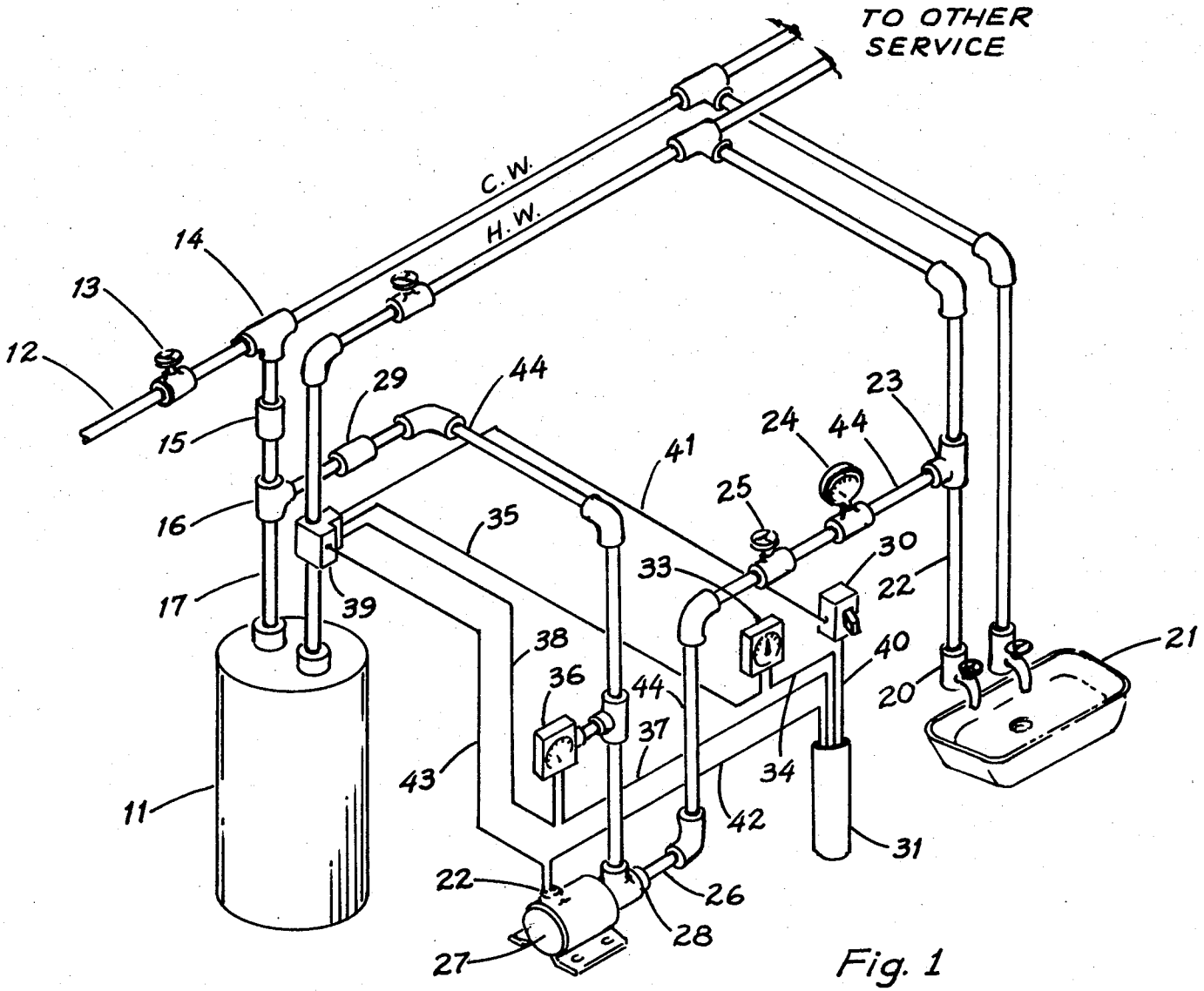
FIG. 1 is a schematic view of the water conservation system showing the plumbing and electrical arrangement in accordance with the present invention.

Referring now to FIG. 1, there is shown in schematic form a typical water distribution system with the preferred embodiment of the invention. The water distribution system of the present invention utilizes a pressurized cold water source 12 which is typically a city water main distributed at a pressure P1 and controlled into a dwelling or building by a shut-off valve 13. The cold water source is distributed to the cold water lines C.W. of the system and to the inlet side 17 of a hot water heater 11 by a tee connection 14. The inlet side 17 is generally provided with a first check valve 15 to prevent backup of hot water into the cold water source 12. Hot water is then distributed from the outlet side 18 of hot water heater 11 through the hot water lines H.W. to the inlet side 22 of the hot water faucet 20 and to a plurallity of other services 19. The principal object of the present invention is to conserve the water which is standing and cooled off in the hot water line H.W. between outlet 18 of hot water heater 11 and inlet 22 of hot water faucet 20 and which typically is allowed to go down the drain 21 while waiting for warm water to flow through inlet side 22 of hot water faucet 20. The present invention as is illustrated in FIG. 1 by way of example provides a recirculating cooled hot water supply line 44 connected between tee connection 16 at the inlet side 17 of hot water heater 11 and tee connection 23 upstream of inlet side 22 of outlet faucet 20 to allow a user to recirculate the cooled hot water rather than waste it if the water temperature is not suitable. Parallel control means 30,33 and 36 are provided to electrically connect centrifugal pump 27 to an electrical source 31.

To accomplish the low-pressure shut-off objective, a pressure switch 39 such as SquareD No. 4×789 manufactured by W. W. Grainger, Inc., is placed upstream of outlet 18 to sense the hot water pressure and to energize pump 27 at a predetermined pressure by providing an electrical connection from source 31 by way of parallel control means 30, 33 and 36.

In accordance with the present invention, the recirculating cooled hot water supply line 44 is comprised of tee 23 located on H.W. line connected in close proximity to inlet 22 of faucet 20, an in-line temperature gauge 24, a shut-off valve 25, a centrifugal pump 27 having an input side 26 and output side 28, a thermostat control switch 36, a second check valve 29 and tee 16 connected downstream of first check valve 15 and upstream of hot water heater inlet side 17.

Figure 2:
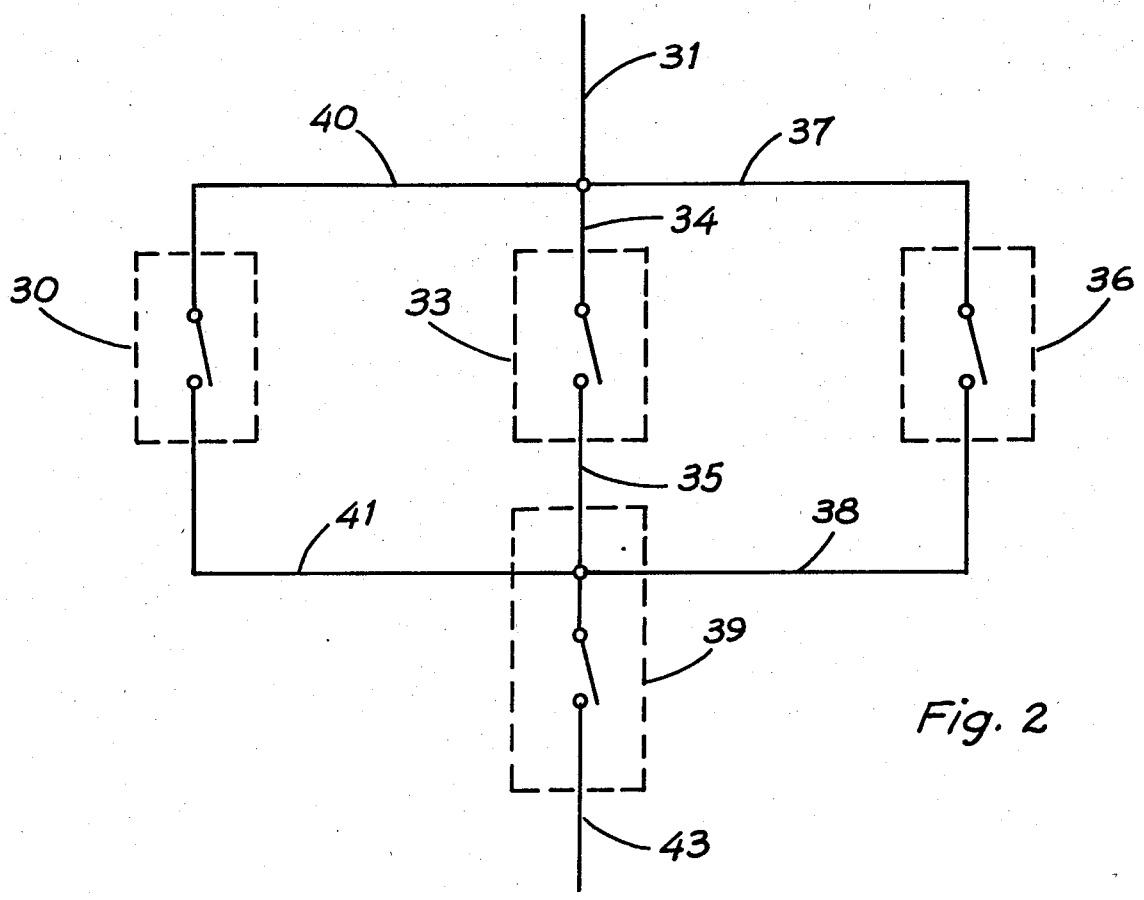
FIG. 2 is an electrical wiring diagram showing the pressure dependent switch gating the electrical input to the recirculating pump from the various power on/off control means.

Referring to FIG. 2, electrical source 31 is connected to lines 34, 37 and 40 which are connected to timer clock control means 33, thermostat control means 36 and manual on/off control means 30, respectively. Timer clock means 33, thermostat control means 36 and manual on/off control means 30 having output lines 35,38, and 41, respectively connected to pressure control switch 39 having output line 43 connected to electrical connection 32 on centrifugal pump 27. Line 42 from pump 27 returns electrical current back to electrical source 31. Assuming that main water supply line 12 is providing adequate pressure, then pressure control switch 39 will be in a closed switch position allowing utilization of the system by actuating any of the control means 30, 33 or 36. When using timer clock 33, a user will be able to set the system to operate during a predetermined time interval to circulate the cooled hot water periodically, independent of any particular water temperature. Automatic utilization at a predetermined water temperature is accomplished with thermostat control means 36. Discretionary utilization is accomplished by using manual on/off switch 30 which is preferably located close to temperature gauge 24. If the main water supply does not have sufficient pressure, pressure control switch 39 will be in an open switch position and thus will prevent utilization of the system.

When the system is not in use water pressure P1 from the main water supply will cause first check valve 15 to open and allow water to enter at water heater inlet 17. Second check valve 29 will be forced closed by pressure P1. Pressure P1 will be sensed by pressure switch 39 and will maintain its closed position so long as P1 is present. If P1 is lost, pressure switch 39 will be open. During utilization of the system, pump 27 will generate water pressure P2 greater than P1 which will force open second check valve 29 and close first check valve 15. If the user is using the system with manual control switch 30, the recirculation will continue until the desired temperature is visually indicated on temperature gauge 24. If the user is depending on thermostat means 36, the recirculation will continue until the set thermostat temperature is reached. If the user is depending on periodic recirculation by means of timer clock 33, then the recirculation will occur during the set on/off interval of clock 33.

When the user selects either utilization by thermostat means 36 or manual on/off switch 30, there is 100% conservation of the cooled hot water in hot water lines H.W. Also, the system can be adapted to interconnect other cooled hot water lines to use the same centrifugal pump 27 and could be provided with local temperature gauges similar to temperature gauge 24 and on/off switches similar to on/off switch 30.

While the present invention has been shown and described herein in what is conceived to be the most practical and preferred embodiment, it is recognized that departures can be made therefrom within the scope of the invention, which is therefore not to be limited to the details disclosed herein but is to be accorded the full scope of the claims so as to embrace any and all equivalent devices.

I claim:

1. An improved water conservation system for use in a dwelling or other building having a pressurized main water supply, a hot water heater, a recirculating cooled hot water supply line, said hot water heater having a cold water inlet side and a hot water outlet side, said inlet side being primarily connected to said main water supply through a first check valve and secondarily connected to said recirculating cooled hot water supply line by means of a tee connection located upstream of said inlet side and downstream of said first check valve, said hot water outlet side being connected to a plurality of hot water lines which feed hot water outlet faucets at wash basins, sinks or the like, comprising:

a second check valve, said second check valve being located in said recirculating cooled hot water supply line upstream of said tee connection;

an electrically controlled recirculating centrifugal pump in said recirculating cooled hot water supply line, said pump being located upstream of said second check valve, said pump also being capable of producing water pressure which is sufficient to open said second check valve and close said first check valve when said pump is electrically energized;

a hot water faucet tee connection, said hot water faucet tee connection being located in close proximity to said hot water outlet faucets at said wash basins, said hot water faucet tee connection couples said hot water lines feeding said hot water faucets and said recirculating cooled hot water supply line;

an in-line temperature gauge in said recirculating cooled hot water supply line, said in-line temperature gauge having a visual numerical temperature value readout and being located in close proximity to said hot water faucet tee connection to better sense the temperature of the water at said hot water outlet faucets;

a manually-operated electrical on/off switch connected to an electrical source for controlling discretionary utilization of said water conservation system, said electrical on/off switch being conveniently located at each location of said hot water outlet faucets near said in-line temperature gauge whereby said electrical on/off switch can be manually operated at user's discretion to energize said recirculating centrifugal pump to recirculate the cooled hot water until said in-line temperature gauge readout indicates that the temperature of the hot water at said hot water faucets has reached a desired temperature; and a pressure switch located upstream and in close proximity of said hot water heater outlet side, said pressure switch sensing the water pressure of the system and said pressure switch electrically wired in series with said electrical on/off switch and said recirculating centrifugal pump for preventing the electrical energizing of said recirculating centrifugal pump by said manual-operated electrical on/off switch if the water pressure from said main water supply has fallen below a predetermined pressure.

2. An improved water conservation system for use in a dwelling or other building having a pressurized main water supply, a hot water heater, a recirculating cooled hot water supply line, said hot water heater having a cold water inlet side and a hot water outlet side, said inlet side being primarily connected to said main water supply through a first check valve and secondarily connected to said recirculating cooled hot water supply line by means of a tee connection located upstream of said inlet side and downstream of said first check valve, said hot water outlet side being connected to a plurality of hot water lines which feed hot water outlet faucets at wash basins, sinks or the like, comprising:

a second check valve, said second check valve being located in said recirculating cooled hot water supply line upstream of said tee connection;

an electrically controlled recirculating centrifugal pump in said recirculating cooled hot water line, said pump being located upstream of said second check valve, said pump also being capable of producing water pressure which is sufficient to open said second check valve and close said first check valve when said pump is electrically energized;

a hot water faucet tee connection, said hot water faucet tee connection being located in close proximity to said hot water outlet faucets at said wash basins, said hot water faucet tee connection couples said hot water lines feeding said hot water faucets and said recirculating cooled hot water supply line;

an in-line temperature gauge in said recirculating cooled hot water supply line, said in-line temperature gauge having a visual numerical temperature value readout and being located in close proximity to said hot water faucet tee connection to better sense the temperature of the water at said hot water outlet faucets;

a manually-operated electrical on/off switch connected to an electrical source for controlling discretionary utilization of said water conservation system, said electrical on/off switch being conveniently located at each location of said hot water outlet faucets near said in-line temperature gauge whereby said electrical on/off switch can be manually operated at user's discretion to energize said recirculating centrifugal pump to recirculate the cooled hot water until said in-line temperature gauge readout indicates that the temperature of the hot water at said hot water faucets has reached a desired temperature;

a pressure switch located upstream and in close proximity of said hot water heater outlet side, said pressure switch sensing the water pressure of the system and being electrically wired in series with said electrical on/off switch for preventing the electrical energizing of said recirculating centrifugal pump by said manual-operated electrical on/off switch if the water pressure from said main water supply has fallen below a predetermined low pressure and allowing the energizing of said recirculating centrifugal pump if the water pressure is above said predetermined low pressure;

a timer clock switch electrically wired in parallel with said electrical on/off switch and similarly wired to said electrical source and also wired in series with said pressure switch so that said timer clock switch will energize said recirculating centrifugal pump only if the water pressure from said main water supply is above said predetermined low pressure and will not energize said centrifugal pump if the water pressure from said main water supply is below said predetermined low pressure; and a thermostat control switch suitably installed in said recirculating cooled hot water supply line, electrically connected to said electrical source and wired in parallel with said electrical on/off switch and said timer clock switch and in series electrical connection with said pressure switch such that said thermostat control switch will automatically energize said recirculating electrical on/off switch at a preset thermostat temperature provided that said pressure switch senses that the water pressure from said main water supply is above said predetermined low pressure and will not energize said recirculating centrifugal pump if said pressure switch senses that the pressure from said main water supply is below said predetermined low pressure.

* * * * *